US007912729B2

(12) United States Patent
Nongpiur et al.

(10) Patent No.: US 7,912,729 B2
(45) Date of Patent: Mar. 22, 2011

(54) HIGH-FREQUENCY BANDWIDTH EXTENSION IN THE TIME DOMAIN

(75) Inventors: Rajeev Nongpiur, Vancouver (CA); Phillip A. Hetherington, Port Moody (CA)

(73) Assignee: QNX Software Systems Co., Ottawa (CA)

( * ) Notice: Subject to any disclaimer, the term of this patent is extended or adjusted under 35 U.S.C. 154(b) by 960 days.

(21) Appl. No.: 11/809,952

(22) Filed: Jun. 4, 2007

(65) Prior Publication Data

US 2008/0208572 A1 Aug. 28, 2008

Related U.S. Application Data

(60) Provisional application No. 60/903,079, filed on Feb. 23, 2007.

(51) Int. Cl.
*G10L 21/00* (2006.01)

(52) U.S. Cl. ..... 704/500; 704/200; 704/223; 381/23

(58) Field of Classification Search ..... 704/200, 704/223, 500; 381/23
See application file for complete search history.

(56) References Cited

U.S. PATENT DOCUMENTS

| | | | |
|---|---|---|---|
| 4,255,620 | A | 3/1981 | Harris et al. |
| 4,343,005 | A | 8/1982 | Han et al. |
| 4,672,667 | A | 6/1987 | Scott et al. |
| 4,700,360 | A | 10/1987 | Visser |
| 4,741,039 | A | 4/1988 | Bloy |
| 4,873,724 | A | 10/1989 | Satoh et al. |
| 4,953,182 | A | 8/1990 | Chung |
| 5,086,475 | A | 2/1992 | Kutaragi et al. |
| 5,335,069 | A | 8/1994 | Kim |
| 5,345,200 | A | 9/1994 | Reif |
| 5,371,853 | A | 12/1994 | Kao et al. |
| 5,396,414 | A | 3/1995 | Alcone |
| 5,416,787 | A | 5/1995 | Kodama et al. |
| 5,455,888 | A | 10/1995 | Iyengar et al. |
| 5,497,090 | A | 3/1996 | Macovski |
| 5,581,652 | A | 12/1996 | Abe et al. |
| 5,771,299 | A | 6/1998 | Melanson |
| 5,950,153 | A | 9/1999 | Ohmori et al. |
| 6,115,363 | A | 9/2000 | Oberhammer et al. |
| 6,144,244 | A | 11/2000 | Gilbert |

(Continued)

FOREIGN PATENT DOCUMENTS

EP 0 497 050 A3 8/1992

(Continued)

OTHER PUBLICATIONS

Qian et al, "Combining Equalization and Estimation of Bandwith Extension of Narrowband Speech," Acoustics, Speech, and Signal Processing, 2004. Proceedings. (ICASSP '04). IEEE International Conference on May 2004, pp. I-713-716.

(Continued)

*Primary Examiner* — Daniel D Abebe
(74) *Attorney, Agent, or Firm* — Brinks Hofer Gilson & Lione

(57) ABSTRACT

A system extends the high-frequency spectrum of a narrow band audio signal in the time domain. The system extends the harmonics of vowels by introducing a non linearity in a narrow band signal. Extended consonants are generated by a random-noise generator. The system differentiates the vowels from the consonants by exploiting predetermined features of a speech signal.

18 Claims, 11 Drawing Sheets

U.S. PATENT DOCUMENTS

| | | | | |
|---|---|---|---|---|
| 6,154,643 | A | 11/2000 | Cox | |
| 6,157,682 | A | 12/2000 | Oberhammer | |
| 6,195,394 | B1 | 2/2001 | Arbeiter et al. | |
| 6,208,958 | B1 | 3/2001 | Cho et al. | |
| 6,226,616 | B1 | 5/2001 | You et al. | |
| 6,295,322 | B1 | 9/2001 | Arbeiter et al. | |
| 6,504,935 | B1 | 1/2003 | Jackson | |
| 6,513,007 | B1 | 1/2003 | Takahashi | |
| 6,539,355 | B1 | 3/2003 | Omori et al. | |
| 6,577,739 | B1 | 6/2003 | Hurtig et al. | |
| 6,615,169 | B1 | 9/2003 | Ojala et al. | |
| 6,681,202 | B1 | 1/2004 | Miet et al. | |
| 6,691,083 | B1 | 2/2004 | Breen | |
| 6,704,711 | B2 | 3/2004 | Gustafsson et al. | |
| 6,829,360 | B1 | 12/2004 | Iwata et al. | |
| 6,889,182 | B2 * | 5/2005 | Gustafsson | 704/205 |
| 6,895,375 | B2 | 5/2005 | Malah et al. | |
| 7,181,402 | B2 | 2/2007 | Jax et al. | |
| 7,191,136 | B2 | 3/2007 | Sinha et al. | |
| 7,248,711 | B2 | 7/2007 | Allegro et al. | |
| 7,461,003 | B1 | 12/2008 | Tanrikulu | |
| 7,546,237 | B2 * | 6/2009 | Nongpiur et al. | 704/209 |
| 2001/0044722 | A1 | 11/2001 | Gustafsson et al. | |
| 2002/0128839 | A1 * | 9/2002 | Lindgren et al. | 704/258 |
| 2002/0138268 | A1 | 9/2002 | Gustafsson | |
| 2003/0009327 | A1 | 1/2003 | Nilsson et al. | |
| 2003/0050786 | A1 | 3/2003 | Jax et al. | |
| 2003/0093278 | A1 | 5/2003 | Malah | |
| 2003/0158726 | A1 | 8/2003 | Philippe et al. | |
| 2004/0028244 | A1 | 2/2004 | Tsushima et al. | |
| 2004/0158458 | A1 | 8/2004 | Sluijter et al. | |
| 2004/0166820 | A1 | 8/2004 | Sluijter et al. | |
| 2004/0174911 | A1 | 9/2004 | Kim et al. | |
| 2004/0264721 | A1 | 12/2004 | Allegro et al. | |
| 2005/0021325 | A1 | 1/2005 | Seo et al. | |
| 2005/0267739 | A1 | 12/2005 | Konito et al. | |
| 2007/0105269 | A1 | 5/2007 | Maher et al. | |
| 2007/0124140 | A1 * | 5/2007 | Iser et al. | 704/223 |
| 2007/0150269 | A1 * | 6/2007 | Nongpiur et al. | 704/226 |

FOREIGN PATENT DOCUMENTS

| | | | |
|---|---|---|---|
| EP | 0 706 299 | A3 | 4/1996 |
| WO | WO 98/06090 | A1 | 2/1998 |
| WO | WO 01/18960 | A1 | 3/2001 |
| WO | WO 2005/015952 | A1 | 2/2005 |

OTHER PUBLICATIONS

Iser et al., "Bandwidth Extension of Telephony Speech" Eurasip Newsletter, vol. 16, Nr. 2, Jun. 2-24, 2005, pp. 2-24.

Kornagel, Spectral widening of the Excitation Signal of Telephone-Band Speech Enhancement. Proceedings of the IWAENC, 2001, pp. 215-218.

"Introduction of DSP", Bores Signal Processing, http:www.bores.com/courses/intro/times/2_concor.htm, Apr. 23, 1998 update, pp. 1-3.

Vary, "Advanced Signal Processing in Speech Communication," in Proceedings of European Signal Processing Conference (EUSIPCO), Vienna, Austria, Sep. 2004, pp. 1449-1456.

Kornagel, "Improved Artificial Low-Pass Extension of Telephone Speech," International Workshop on Acoustic Echo and Noise Control (IWAENC2003), Sep. 2003, pp. 107-110.

McClellan et al. "Signal Processing First," Prentice Hall, Lab 07, pp. 1-12.

"Convention Paper" by Audio Engineering Society, Presented at the 115$^{th}$ Convention, Oct. 10-13, 2003, New York, NY, USA (16 pages).

"Neural Networks Versus Codebooks in an Application for Bandwidth Extension of Speech Signals" by Bernd Iser, Gerhard Schmidt, Temic Speech Dialog Systems, Soeflinger Str. 100, 89077 Ulm, Germany; Proceedings of Eurospeech 2003 (4 pages).

* cited by examiner

HIGH-FREQUENCY BANDWIDTH EXTENSION IN THE TIME DOMAIN

PRIORITY CLAIM

This application claims the benefit of priority from U.S. Provisional Application No. 60/903,079, Feb. 23, 2007. The entire content of the application is incorporated by reference, except that in the event of any inconsistent disclosure from the present application, the disclosure herein shall be deemed to prevail.

BACKGROUND OF THE INVENTION

1. Technical Field

This system relates to bandwidth extension, and more particularly, to extending a high-frequency spectrum of a narrowband audio signal 2. Related Art Some telecommunication systems transmit speech across a limited frequency range. The receivers, transmitters, and intermediary devices that makeup a telecommunication network may be band limited. These devices may limit speech to a bandwidth that significantly reduces intelligibility and introduces perceptually significant distortion that may corrupt speech.

While users may prefer listening to wideband speech, the transmission of such signals may require the building of new communication networks that support larger bandwidths. New networks may be expensive and may take time to become established. Since many established networks support a narrow band speech bandwidth, there is a need for systems that extend signal bandwidths at receiving ends.

Bandwidth extension may be problematic. While some bandwidth extension methods reconstruct speech under ideal conditions, these methods cannot extend speech in noisy environments. Since it is difficult to model the effects of noise, the accuracy of these methods may decline in the presence of noise. Therefore, there is a need for a robust system that improves the perceived quality of speech.

SUMMARY

A system extends the high-frequency spectrum of a narrowband audio signal in the time domain. The system extends the harmonics of vowels by introducing a non linearity in a narrowband signal. Extended consonants are generated by a random-noise. The system differentiates the vowels from the consonants by exploiting predetermined features of a speech signal.

Other systems, methods, features, and advantages will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

A system extends the high-frequency spectrum of a narrowband audio signal in the time domain. The system extends the harmonics of vowels by introducing a non linearity in a narrowband signal. Extended consonants may be generated by a random-noise generator. The system differentiates the vowels from the consonants by exploiting predetermined features of a speech signal. Some features may include a high level low-frequency energy content of vowels, the high high-frequency energy content of consonants, the wider envelop of vowels relative to consonants, and/or the background noise, and mutual exclusiveness between consonants and vowels. Some systems smoothly blend the extended signals generated by the multiple modes, so that little or substantially no artifacts remain in the resultant signal. The system provides the flexibility of extending and shaping the consonants to a desired frequency level and spectral shape. Some systems also generate harmonics that are exact or nearly exact multiples of the pitch of the speech signal.

A method may also generate a high-frequency spectrum from a narrowband (NB) audio signal in the time domain. The method may extend the high-frequency spectrum of a narrowband audio signal. The method may use two or more techniques to extend the high-frequency spectrum. If the signal in consideration is a vowel, then the extended high-frequency spectrum may be generated by squaring the NB signal. If the signal in consideration is a consonant or background noise, a random signal is used to represent that portion of the extended spectrum. The generated high-frequency signals are filtered to adjust their spectral shapes and magnitudes and then combined with the NB signal.

The high-frequency extended signals may be blended temporally to minimize artifacts or discontinuities in the bandwidth-extended signal. The method provides the flexibility of extending and shaping the consonants to any desired frequency level and spectral shape. The method may also generate harmonics of the vowels that are exact or nearly exact multiples of the pitch of the speech signal.

Figure 1:
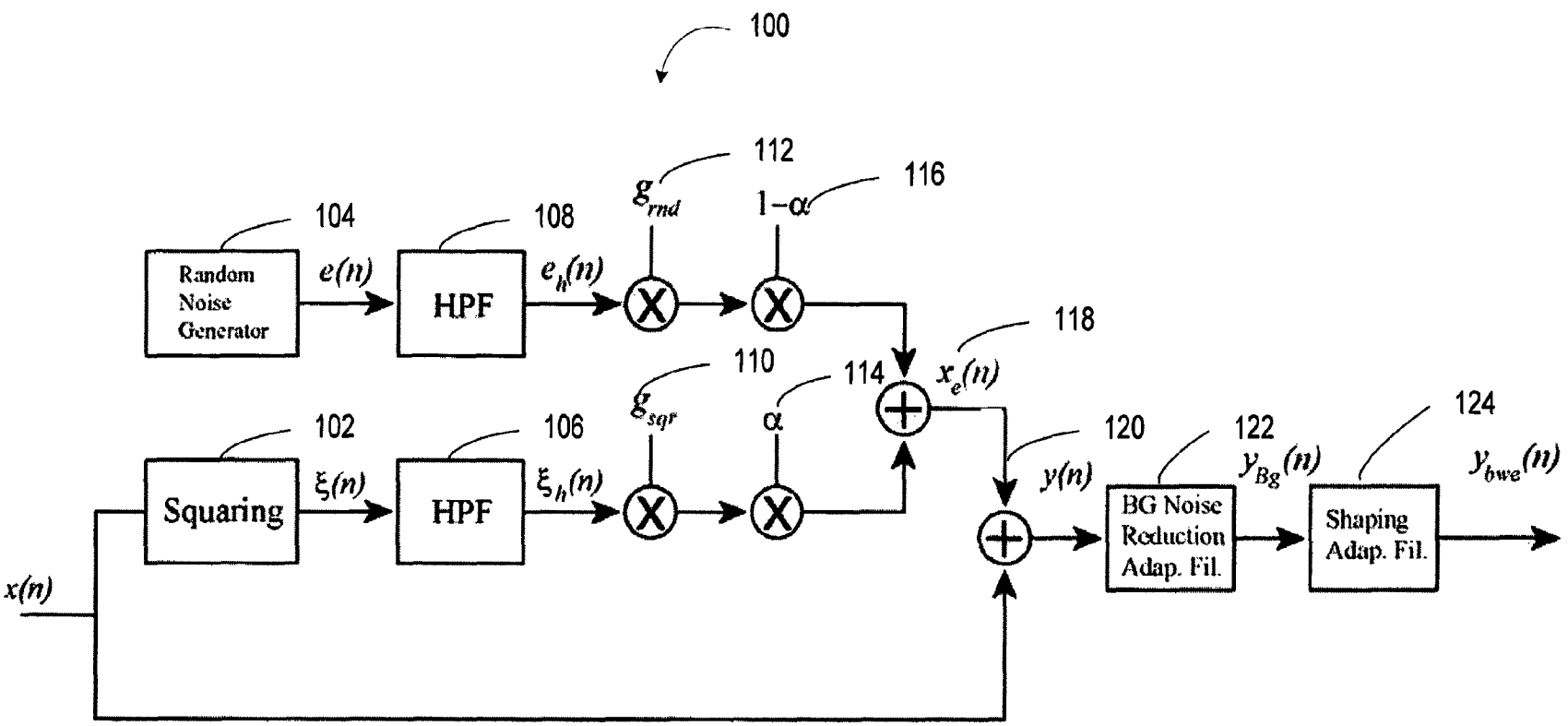
FIG. 1 is a block diagram of a high-frequency bandwidth extension system.

A block diagram of the high-frequency bandwidth extension system 100 is shown in FIG. 1. An extended high frequency signal may be generated by squaring the narrow band (NB) signal through a squaring circuit and by generating a random noise through a random noise generator 104. Both signals pass through electronic circuits 106 and 108 that pass nearly all frequencies in a signal above one or more specified frequencies. The signals then pass through amplifiers 110 and 112 having gain factors, $g_{rnd}(n)$ and $g_{sqr}(n)$, to give, respectively, the high-frequency signals, $x_{rnd}(n)$ and $x_{sqr}(n)$. Depending upon whether the portion of the speech signal contains more of vowel, consonant, or background noise, the variable, $\alpha$, may be adjusted to select the proportion for combining $x_{rnd}(n)$ and $x_{sqr}(n)$. The signals are processed through mixers 114 and 116 before the signals are summed by adder 118. The resulting high-frequency signal, $x_e(n)$, may then be combined with the original NB signal, x(n), through adder 120 to give the bandwidth extended signal, y(n).

The level of background noise in the bandwidth extended signal, y(n), may be at the same spectral level as the background noise in the NB signal. Consequently, in moderate to high noise the background noise in the extended spectrum may be heard as a hissing sound. To suppress or dampen the background noise in the extended signal, the bandwidth extended signal, y(n), is then passed through a filter 122 that adaptively suppresses the extended background noise while allowing speech to pass through. The resulting signal, $y_{Bg}(n)$, may be further processed by passing through an optional shaping filter 124. A shaping filter may enhance the consonants relative to the vowels and it may selectively vary the spectral shape of some or all of the signal. The selection may depend upon whether the speech segment is a consonant, vowel, or background noise.

The high-frequency signals generated by the random noise generator 104 and by squaring circuit 102 may not be at the correct magnitude levels for combining with the NB signal. Through gain factors, $g_{rnd}(n)$ and $g_{sqr}(n)$, the magnitudes of the generated random noise and the squared NB signal may be adjusted. The notations and symbols used are:

| | | |
|---|---|---|
| $x(n) \rightarrow$ | NB signal | (1) |
| $x_h(n) \rightarrow$ | highpass filtered NB signal | (2) |
| $\sigma_{x_h} \rightarrow$ | magnitude of the highpass filtered background noise of the NB signal | (3) |
| $x_l(n) \rightarrow$ | lowpass filtered NB signal | (4) |
| $\sigma_{x_l} \rightarrow$ | magnitude of the lowpass filtered background noise of the NB signal | (5) |
| $\xi(n) = x^2(n) \rightarrow$ | squared NB signal | (6) |
| $\xi_h(n) \rightarrow$ | highpass-filtered squared-NB signal | (7) |
| $e(n) \rightarrow$ | uniformly distributed random signal of standard deviation of unity | (8) |
| $e_h(n) \rightarrow$ | highpass-filtered random signal | (9) |
| $\alpha \rightarrow$ | mixing proportion between $\xi_h(n)$ and $e_h(n)$ | (10) (11) |

To estimate the gain factor, $g_{rnd}(n)$, the envelop of the high pass filtered NB signal, $x_h(n)$, is estimated. If the random noise generator output is adjusted so that it has a variance of unity then $g_{rnd}(n)$ is given by (12).

$$g_{rnd}(n)=\text{Envelop}[x_h(n)] \tag{12}$$

The envelop estimator is implemented by taking the absolute value of $x_h(n)$ and smoothening it with a filter like a leaky integrator.

The gain factor, $g_{sqr}(n)$, adjusts the envelop of the squared-high pass-filtered NB signal, $\xi_h(n)$, so that it is at the same level as the envelop of the high pass filtered NB signal $x_h(n)$. Consequently, $g_{sqr}(n)$ is given by (13).

$$g_{sqr}(n) = \frac{Envelop[x_h(n)]}{Envelop[\xi_h(n)]} \tag{13}$$

The parameter, $\alpha$, controls the mixing proportion between the gain-adjusted random signal and the gain-adjusted squared NB signal. The combined high-frequency generated signal is expressed as (14).

$$x_e(n)=\alpha g_{rnd}(n)\xi_h(n)+(1-\alpha)g_{sqr}(n)e_h(n) \tag{14}$$

Figure 2:
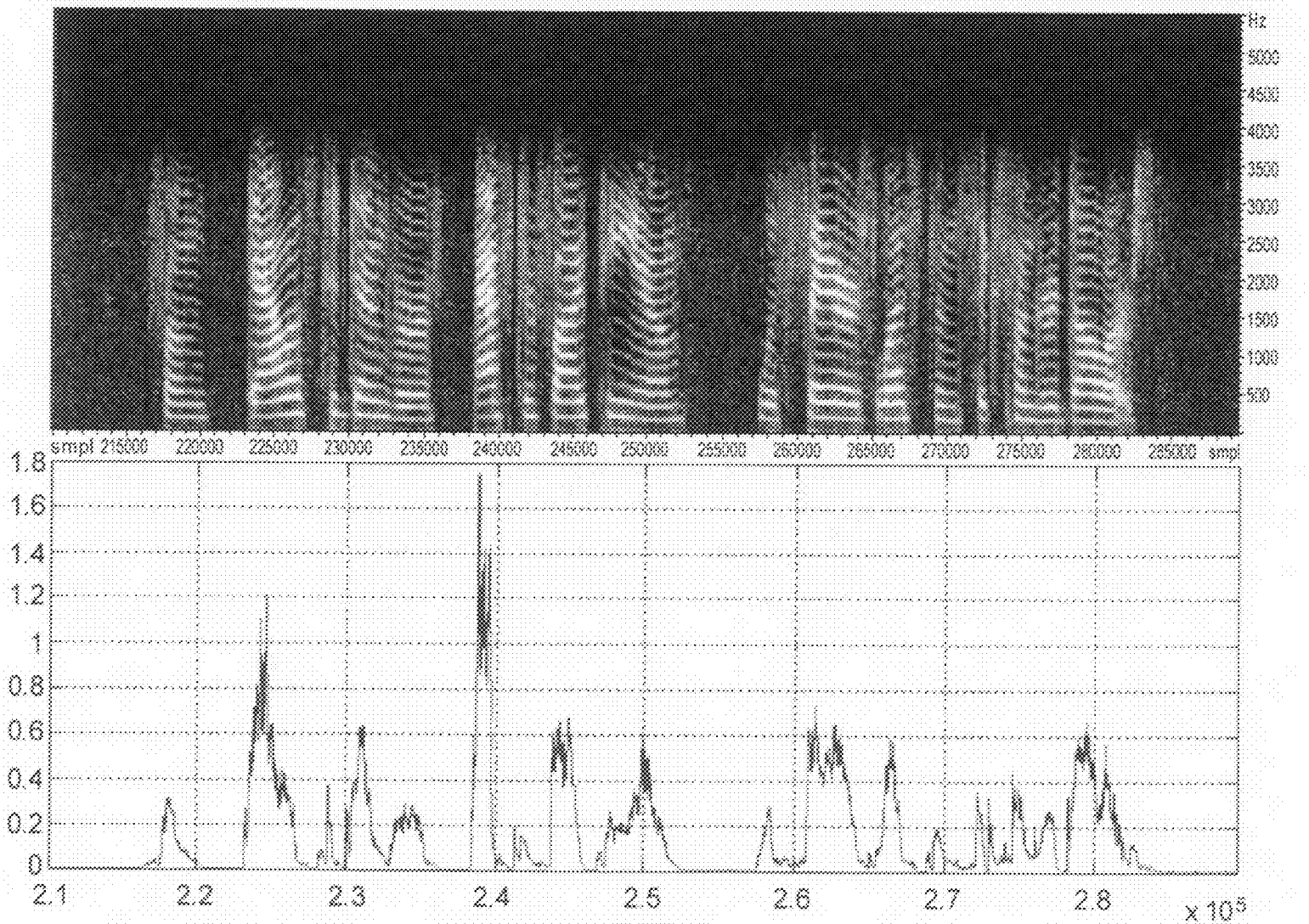
FIG. 2 is a spectrogram of a speech sample and a corresponding plot.

To estimate $\alpha$ some systems measure whether the portion of speech is more random or more periodic; in other words, whether it has more vowel or consonant characteristics. To differentiate the vowels from the consonants and background noise in block, k, of N speech samples, an energy measure, $\eta(k)$, may be used given by (15)

$$\eta(k) = \frac{N \max_{n=kN}^{(k+1)N} \xi(n)}{\sigma_{voice} \sum_{n=kN}^{(k+1)N} |x(n)|} \tag{15}$$

where N is the length of each block and $\sigma_{voice}$ is the average voice magnitude. FIG. 2 shows a spectrogram of a speech sample and the corresponding plot of $\eta(k)$. The values of $\eta(k)$ are higher for vowels and short-duration transients, and lower for consonants and background noise.

Another measure that may be used to detect the presence of vowels detects the presence of low frequency energy. The low frequency energy may range between about 100 to about 1000 Hz in a speech signal. By combining this condition with $\eta(k)$ a may be estimated by (16).

$$\alpha = \begin{cases} 1 & \text{if } \frac{\|x_l\|}{\sigma_{x_l}} > \Gamma_\alpha \\ \gamma(k) & \text{otherwise} \end{cases} \tag{16}$$

In (16) $\Gamma_\alpha$ is an empirically determined threshold, $\|\cdot\|$ is an operator that denotes the absolute mean of the last N samples of data, $\sigma_x$, is the low-frequency background noise energy, and $\gamma(k)$ is given by (17).

$$\gamma(k) = \begin{cases} 0 & \text{if } \eta(k) < \tau_l \\ 1 & \text{if } \eta(k) > \tau_h \\ \frac{\eta(k) - \tau_l}{\tau_h - \tau_l} & \text{otherwise.} \end{cases} \tag{17}$$

In (17) thresholds, $\tau_l$ and $\tau_h$, may be empirically selected such that, $0<\tau_l<\tau_h$.

The extended portion of the bandwidth extended signal, $x_e(n)$, may have a background noise spectrum level that is close to that of the NB signal. In moderate to high noise, this may be heard as a hissing sound. In some systems an adaptation filter may be used to suppress the level of the extended background noise while allowing speech to pass there through.

In some circumstances, the background noise may be suppressed to a level that is not perceived by the human ear. One approximate measure for obtaining the levels may be found from the threshold curves of tones masked by low pass noise. For example, to sufficiently reduce the audibility of background noise above about 3.5 kHz, the power spectrum level above about 3.5 kHz is logarithmically tapered down so that the spectrum level at about 5.5 kHz is about 30 dB lower. In this application, that the masking level may vary slightly with different speakers and different sound intensities.

Figure 3:
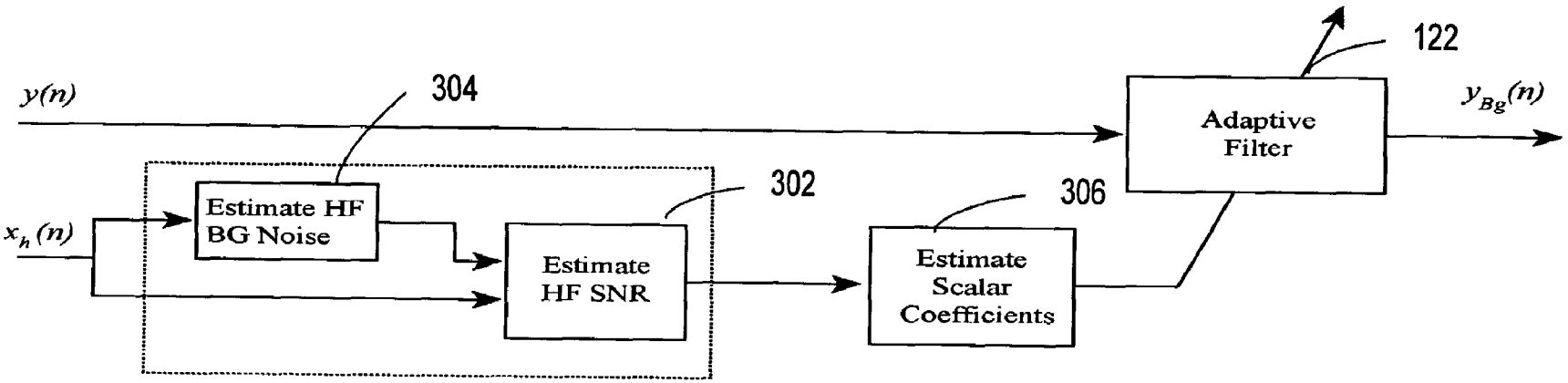
FIG. 3 is a block diagram of an adaptive filter that suppresses background noise.

In FIG. 3, a block diagram of the adaptive filter that may be used to suppress the background noise. An estimating circuit 302 may estimate the high frequency signal-to-noise ration (SNR) of the high frequency by processing the output of a high frequency background noise estimating circuit 304. The adaptive filter coefficients may be estimated by a circuit 306 that estimates the scalar coefficients of the adaptive filter 122. The filter coefficients are updated on the basis of the high frequency energy above background. An adaptive-filter update equation is given by (18).

$$h(k)=\beta_1(k)h_1+\beta_2(k)h_2+\ldots+\beta_L(k)h_L \tag{18}$$

In (18) h(k) is the updated filter coefficient vector, $h_1, h_2, \ldots, h_L$ are the L basis filter-coefficient vectors, and $\beta_1(k), \beta_2(k), \ldots, \beta_L(k)$ are the L scalar coefficients that are updated after every N samples as (19).

$$\beta_i(k)=f_i(\phi_h) \tag{19}$$

In (19) $f_i(z)$ is a certain function of z and $\phi_h$ is the high-frequency signal to noise ratio, in decibels, and given by (20).

$$\phi_h = 10\log_{10}\left[\frac{\|x_h(n)\|}{\sigma_{x_h}}\right] \tag{20}$$

Figure 4:
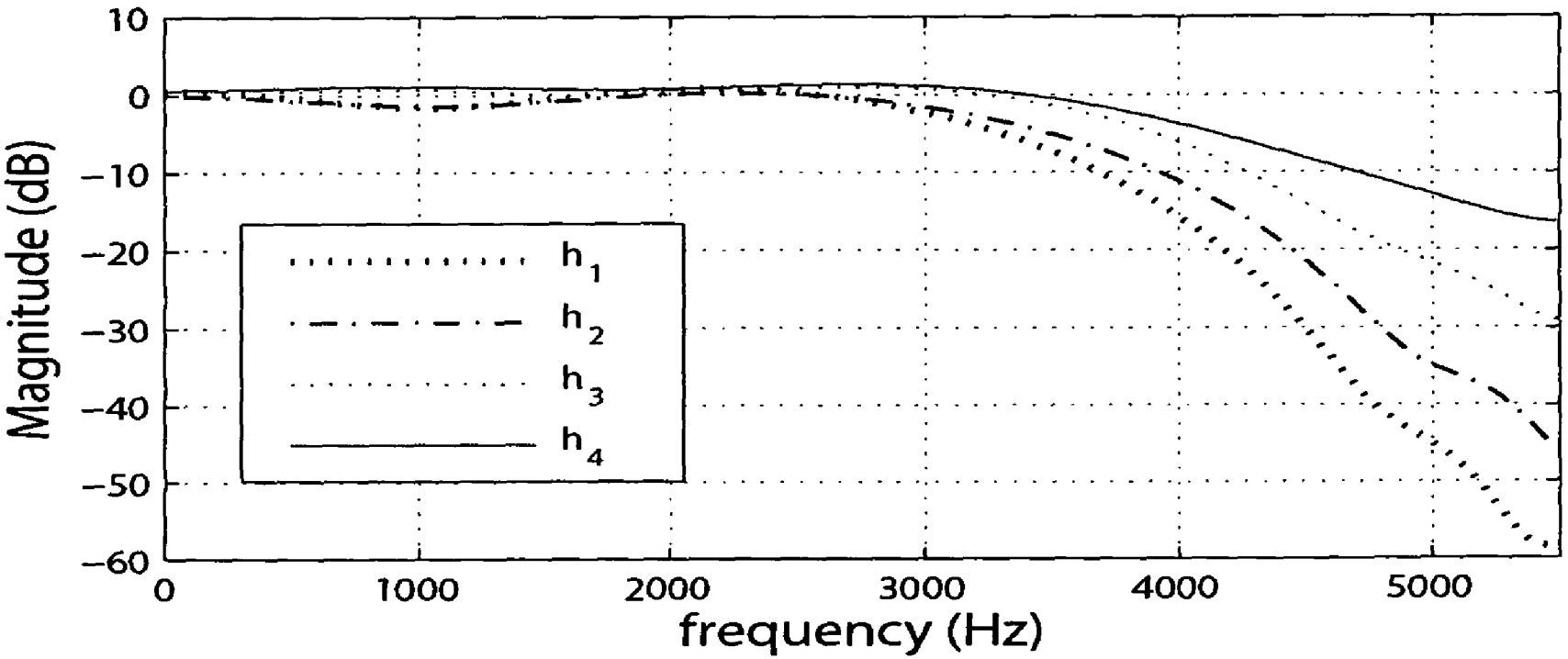
FIG. 4 is an amplitude response of the basis filter-coefficients vectors that may be used in a noise reduction filter.

In some implementations of the adaptive filter 122, four basis filter-coefficient vectors, each of length 7 may be used. Amplitude responses of these exemplary vectors are plotted in FIG. 4. The scalar coefficients, $\beta_1(k), \beta_2(k), \ldots, \beta_L(k)$, may be determined as shown in (21).

$$\begin{bmatrix}\beta_1(k)\\ \beta_2(k)\\ \beta_3(k)\\ \beta_4(k)\end{bmatrix}=\begin{cases}[1,0,0,0]^T & \text{if } \phi_h<\tau_1\\ \left[\frac{\phi_h-\tau_1}{\tau_2-\tau_1},\frac{\tau_3-\phi_h}{\tau_2-\tau_1},0,0\right]^T & \text{if } \tau_1<\phi_h<\tau_2\\ \left[0,\frac{\phi_h-\tau_1}{\tau_3-\tau_2},\frac{\tau_3-\phi_h}{\tau_3-\tau_2},0\right]^T & \text{if } \tau_2<\phi_h<\tau_3\\ \left[0,0,\frac{\phi_h-\tau_2}{\tau_4-\tau_3},\frac{\tau_4-\phi_h}{\tau_4-\tau_3}\right]^T & \text{if } \tau_3<\phi_h<\tau_4\\ [0,0,0,1]^T & \text{if } \phi_h>\tau_4\end{cases} \tag{21}$$

In (21) thresholds, $\tau_1, \tau_2, \tau_3, \tau_4$ are estimated empirically and $\tau_1<\tau_2<\tau_3<\tau_4$.

A shaping filter 124 may change the shape of the extended spectrum depending upon whether speech signal in consideration is a vowel, consonant, or background noise. In the systems above, consonants may require more boost in the extended high-frequency spectrum than vowels or background noise. To this end, a circuit or process may be used to derive an estimate, ζ(k), and to classify the portion of speech as consonants or non-consonants. The parameter, ζ(k), may not be a hard classification between consonants and non-consonants, but, rather, may vary between about 0 and about 1 depending upon whether the speech signal in consideration has more consonant or non-consonant characteristics.

Figure 5:
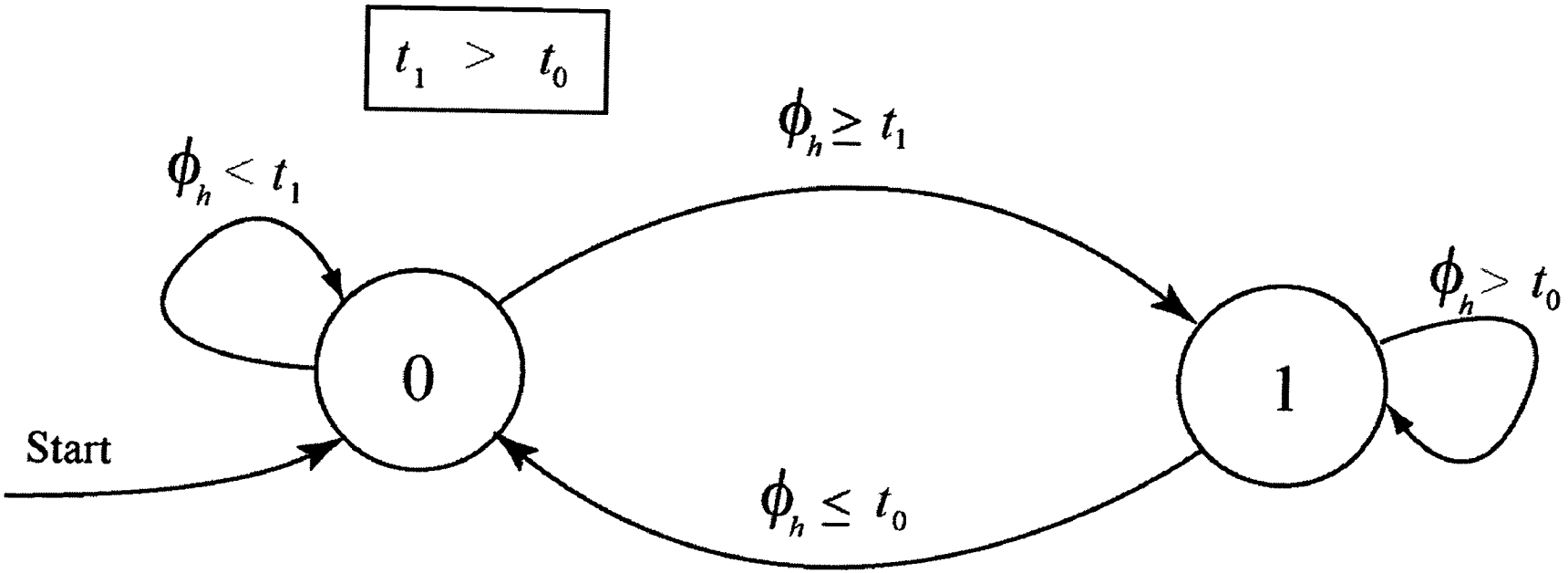
FIG. 5 is a state diagram of a constant detection method.

The parameter, ζ(k), may be estimated on the basis of the low-frequency and high-frequency SNRs and has two states, state 0 and state 1. When in state 0, the speech signal in consideration may be assumed to be either a vowel or background noise, and when in state 1, either a consonant or a high-formant vowel may be assumed. A state diagram depicting the two states and their transitions is shown in FIG. 5. The value of ζ(k) is dependent on the current state as shown in (22), (23), and (24).

When state is 0:

$$\zeta(k)=0 \tag{22}$$

When state is 1:

$$\varsigma(k)=\begin{cases}0 & \text{if } [\sigma_{x_h}]_{\text{dB}}<t_{1l}\\ \chi(k) & \text{if } [\sigma_{x_h}]_{\text{dB}}>t_{1h}\\ \chi(k)([\sigma_{x_h}]_{\text{dB}}-t_{1l})/(t_{1h}-t_{1l}) & \text{otherwise}\end{cases} \tag{23}$$

where χ(k) is given by $$\chi(k)=\begin{cases}1 & \text{if } [\sigma_{x_l}]_{\text{dB}}<t_{2l}\\ 0 & \text{if } [\sigma_{x_l}]_{\text{dB}}>t_{2h}\\ (t_{2h}-[\sigma_{x_l}]_{\text{dB}})/(t_{2h}-t_{2l}) & \text{otherwise}\end{cases} \tag{24}$$

Thresholds, $t_{1l}$, $t_{1h}$, $t_{2l}$, and $t_{2h}$, may be dependent on the SNR as shown in (25).

$$\begin{bmatrix}t_{1l}\\ t_{1h}\\ t_{2l}\\ t_{2h}\end{bmatrix}=\begin{cases}\left[\frac{\sigma_{voice}}{\sigma_{x_l}}\right]_{\text{dB}} I-[c_{1a},c_{2a},c_{3a},c_{4a}]^T & \text{if } \frac{\sigma_{voice}}{\sigma_{x_l}}>\Gamma_t\\ [c_{1b},c_{2b},c_{3b},c_{4b}]^T & \text{otherwise}\end{cases} \tag{25}$$

In (25) I is a 4×1 unity column vector and thresholds, $c_{1a}$, $c_{2a}$, $c_{3a}$, $c_{4a}$, $c_{1b}$, $c_{2b}$, $c_{3b}$, $c_{4b}$, and $\Gamma_t$, are empirically selected.

Figure 6:
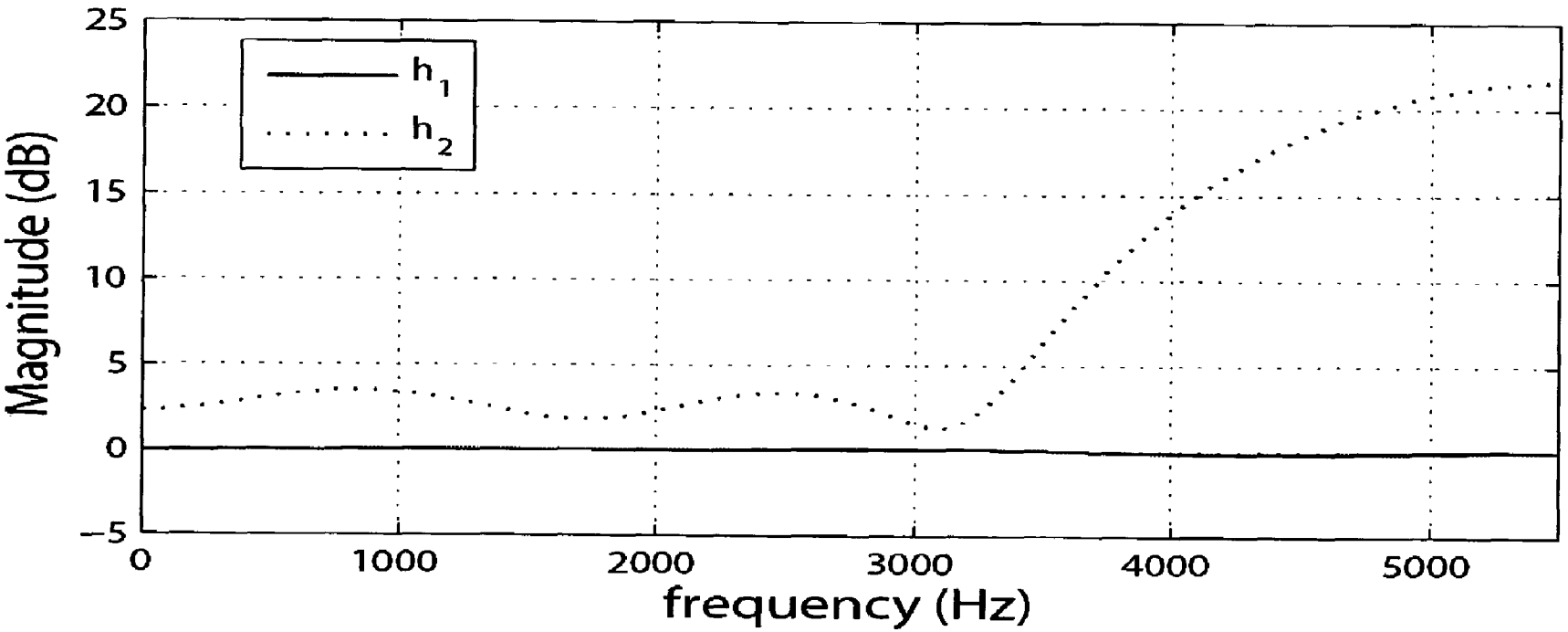
FIG. 6 is an amplitude response of the basis filter-coefficients vectors that may be used to shape an adaptive filter.

The shaping filter may be based on the general adaptive filter in (18). In some systems two basis filter-coefficients vectors, each of length 6 may be used. Their amplitude responses are shown in FIG. 6. The two scalar coefficients, $\beta_1(k)$ and $\beta_2(k)$, are dependent on ζ(k) and given by (26).

$$\begin{bmatrix}\beta_1(k)\\ \beta_2(k)\end{bmatrix}=\begin{bmatrix}\varsigma(k)\\ 1-\varsigma(k)\end{bmatrix} \tag{26}$$

Figure 7:
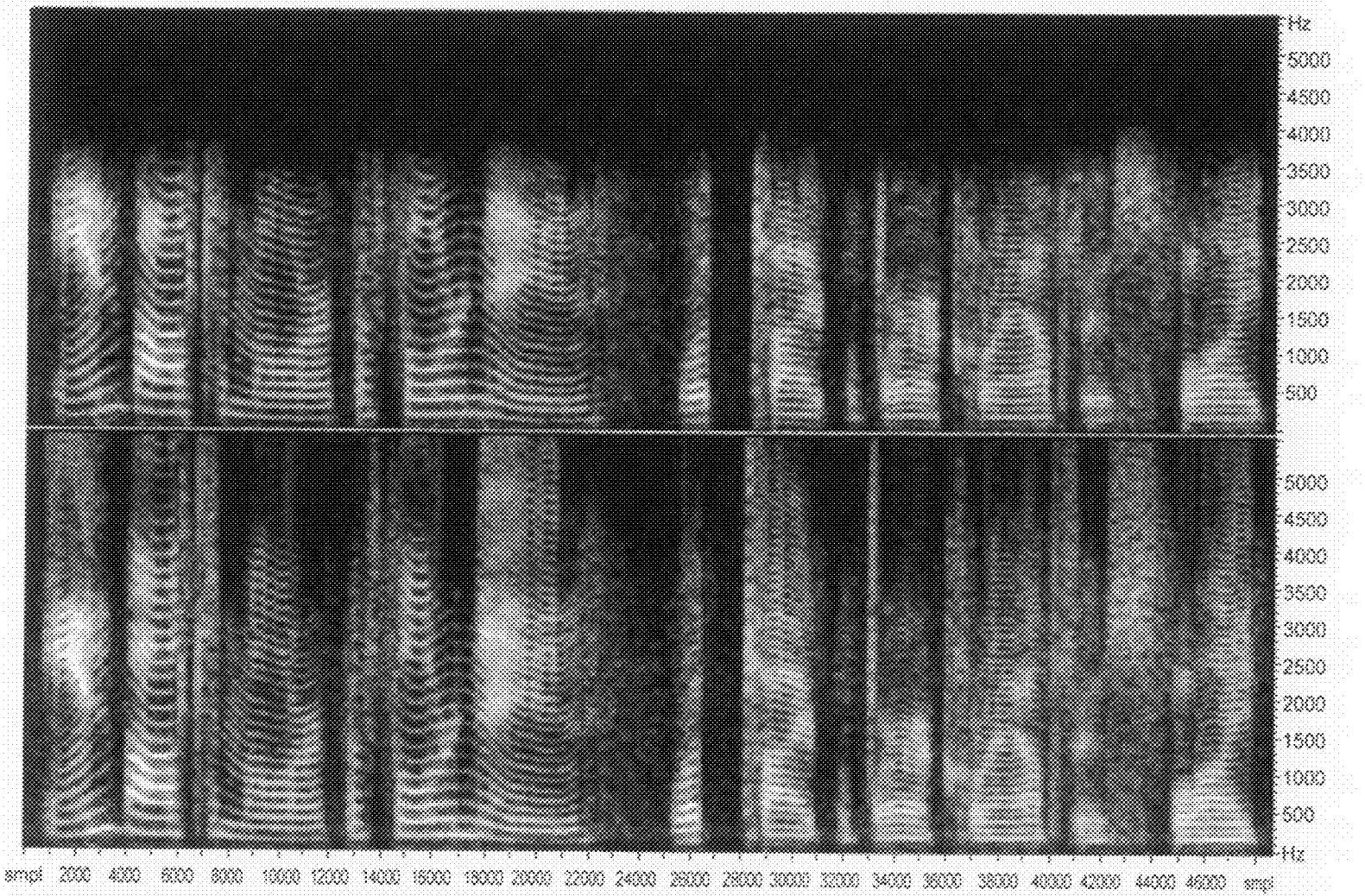
FIG. 7 is a spectrogram of two speech samples.
Figure 8:
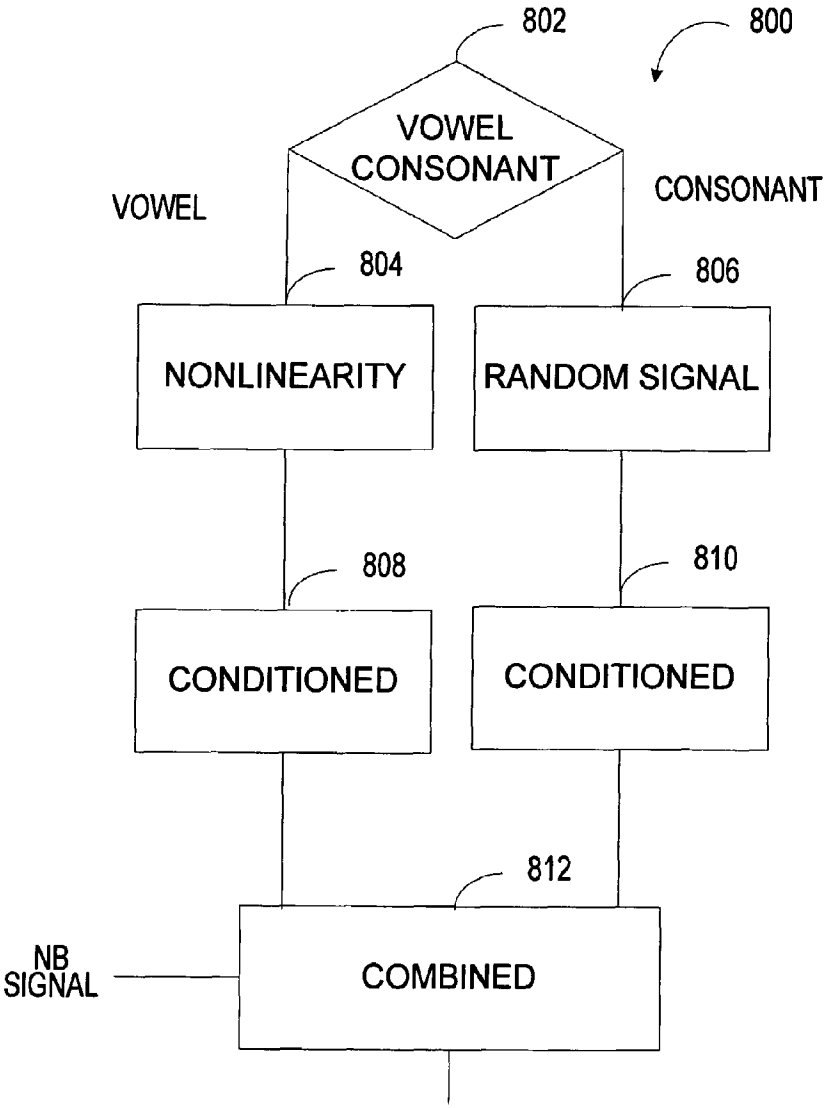
FIG. 8 is method of extending a narrowband signal in the time domain.

The relationship or algorithm may be applied to both speech data that has been passed over CDMA and GSM networks. In FIG. 7 two spectrograms of a speech sample are shown. The top spectrogram is that of a NB signal that has been passed through a CDMA network, while the bottom is the NB signal after bandwidth extension to about 5.5 kHz. The sampling frequency of the speech sample is about 11025 Hz.

A time domain high-frequency bandwidth extension method may generate the periodic component of the extended spectrum by squaring the signal, and the non-periodic component by generating a random using a signal generator. The method classifies the periodic and non-periodic portions of speech through fuzzy logic or fuzzy estimates. Blending of the extended signals from the two modes of generation may be sufficiently smooth with little or no artifacts, or discontinuities. The method provides the flexibility of extending and shaping the consonants to a desired frequency level and provides extended harmonics that are exact or nearly exact multiples of the pitch frequency through filtering.

An alternative time domain high-frequency bandwidth extension method 800 may generate the periodic component of an extended spectrum. The alternative method 800 determines if a signal represents a vowel or a consonant by detecting distinguishing features of a vowel, a consonant, or some combination at 802. If a vowel is detected in a portion of the narrowband signal the method generates a portion of the high frequency spectrum by generating a non-linearity at 804. A non-linearity may be generated in some methods by squaring that portion of the narrow band signal. If a consonant is detected in a portion of the narrowband signal the method generates a second portion of the high frequency spectrum by generating a random signal at 806. The generated signals are conditioned at 808 and 810 before they are combined together with the NB signal at 812. In some methods, the conditioning may include filtering, amplifying, or mixing the respective signals or a combination of these functions. In other methods the conditioning may compensate for signal attenuation, noise, or signal distortion or some combination of these functions. In yet other methods, the conditioning improves the processed signals.

Figure 9:
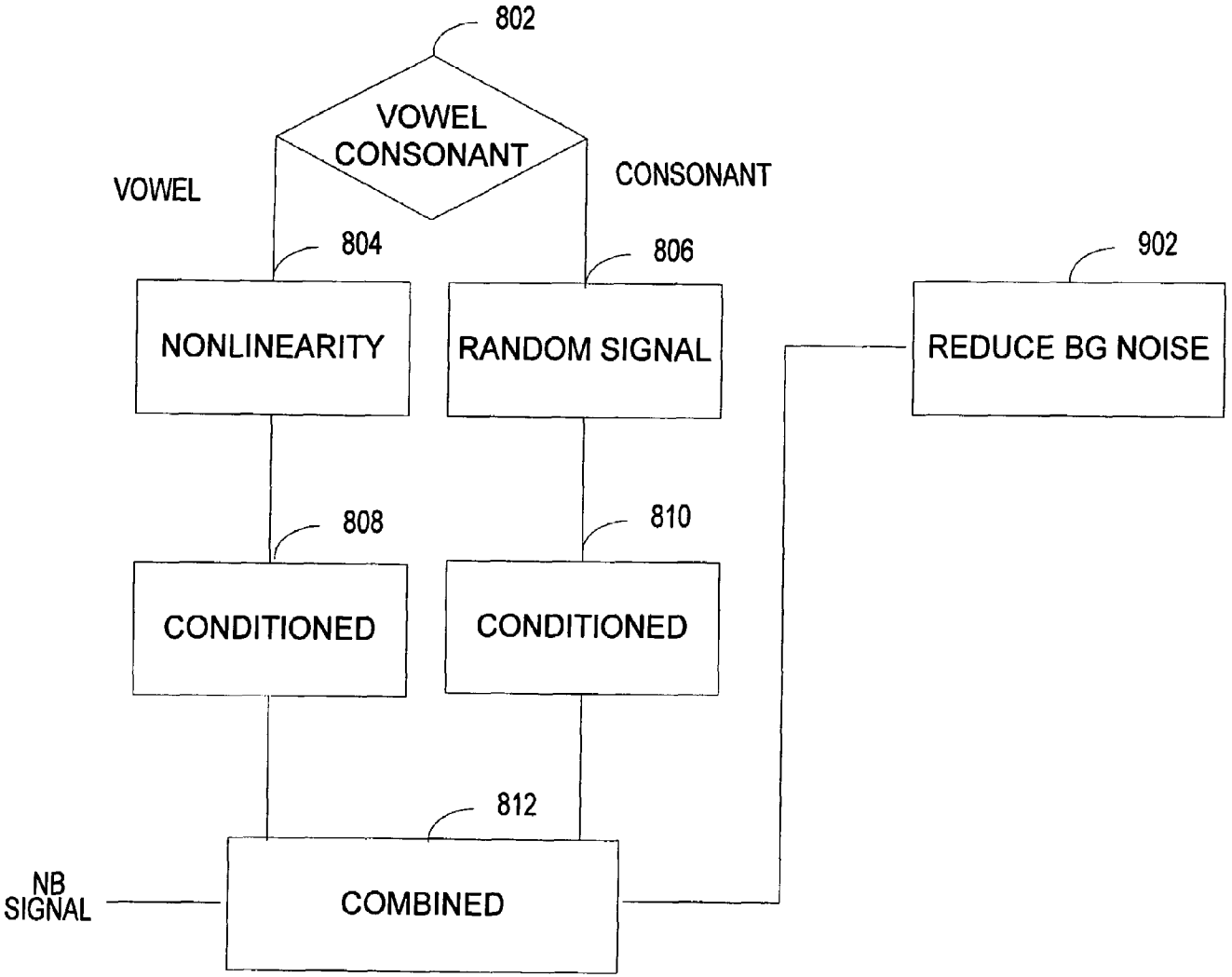
FIG. 9 is a second alternative method of extending a narrowband signal in the time domain.
Figure 10:
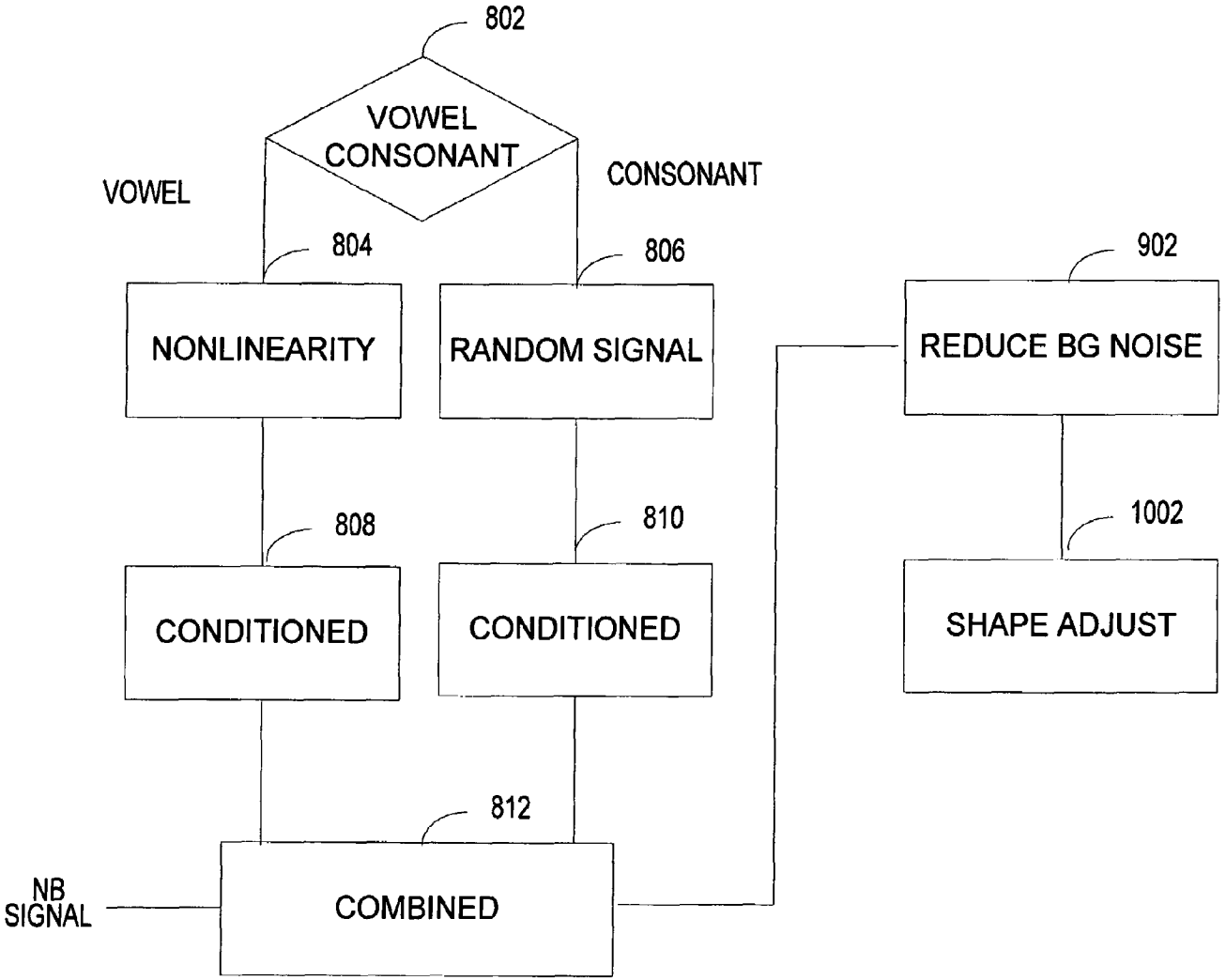
FIG. 10 is a third alternative method of extending a narrowband signal in the time domain.
Figure 11:
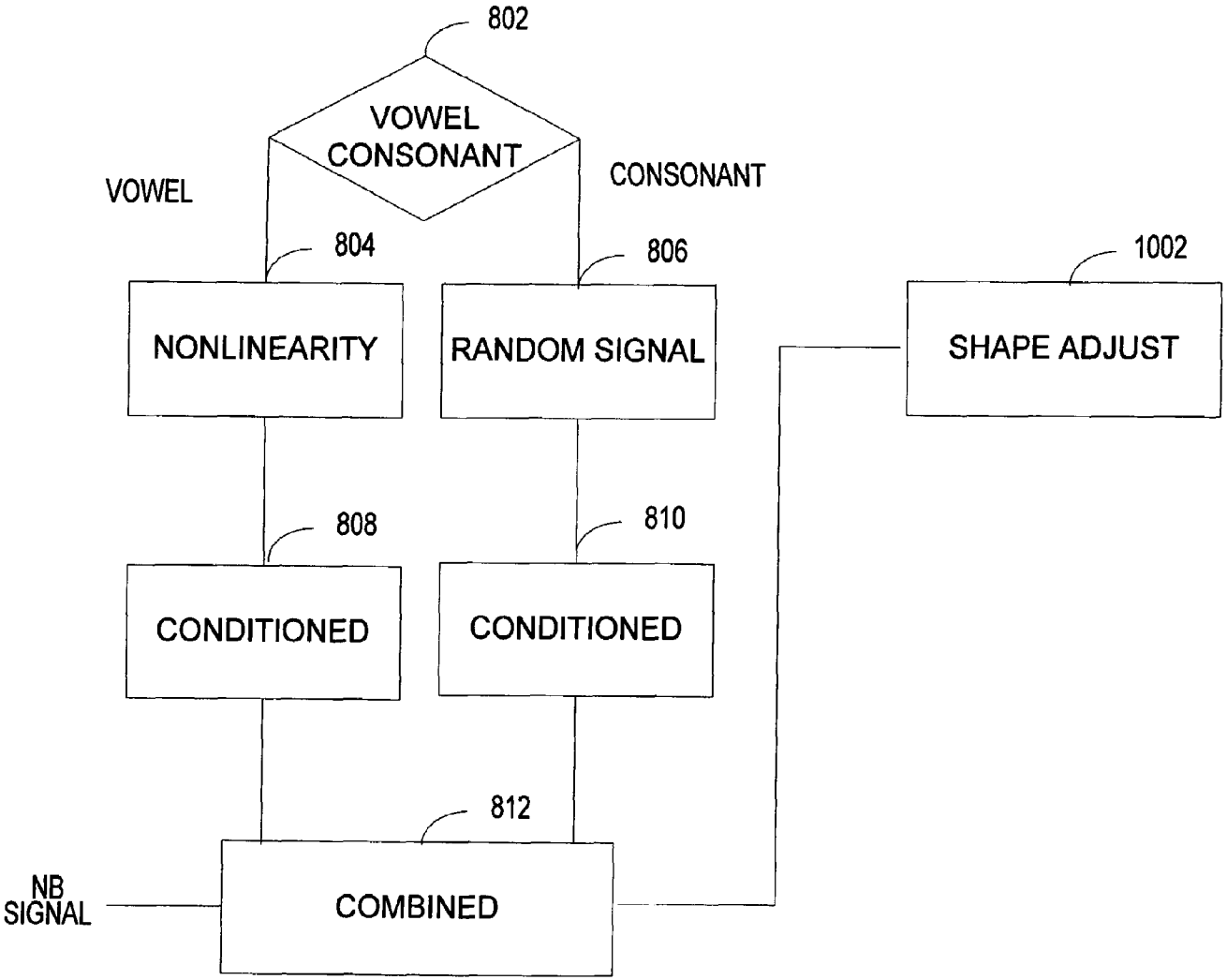
FIG. 11 is a fourth alternative method of extending a narrowband signal in the time domain.

In FIG. 9 background noise is reduced in some methods at 902. Some methods reduce background noise through an optional filter that may adaptively pass selective frequencies. Some methods may adjust spectral shapes and magnitudes of the combined signal at 1002 with or without the reduced background noise (FIG. 10 or FIG. 11). This may occur by further filtering or adaptive filtering the signal.

Each of the systems and methods described above may be encoded in a signal bearing medium, a computer readable medium such as a memory, programmed within a device such as one or more integrated circuits, or processed by a controller or a computer. If the methods are performed by software, the software may reside in a memory resident to or interfaced to the processor, controller, buffer, or any other type of non-volatile or volatile memory interfaced, or resident to speech extension logic. The logic may comprise hardware (e.g., controllers, processors, circuits, etc.), software, or a combination of hardware and software. The memory may retain an ordered listing of executable instructions for implementing logical functions. A logical function may be implemented through digital circuitry, through source code, through analog circuitry, or through an analog source such through an analog electrical, or optical signal. The software may be embodied in any computer-readable or signal-bearing medium, for use by, or in connection with an instruction executable system, apparatus, or device. Such a system may include a computer-based system, a processor-containing system, or another system that may selectively fetch instructions from an instruction executable system, apparatus, or device that may also execute instructions.

A "computer-readable medium," "machine-readable medium," "propagated-signal" medium, and/or "signal-bearing medium" may comprise any apparatus that contains, stores, communicates, propagates, or transports software for use by or in connection with an instruction executable system, apparatus, or device. The machine-readable medium may selectively be, but not limited to, an electronic, magnetic, optical, electromagnetic, infrared, or semiconductor system, apparatus, device, or propagation medium. A non-exhaustive list of examples of a machine-readable medium would include: an electrical connection "electronic" having one or more wires, a portable magnetic or optical disk, a volatile memory such as a Random Access Memory "RAM" (electronic), a Read-Only Memory "ROM" (electronic), an Erasable Programmable Read-Only Memory (EPROM or Flash memory) (electronic), or an optical fiber (optical). A machine-readable medium may also include a tangible medium upon which software is printed, as the software may be electronically stored as an image or in another format (e.g., through an optical scan), then compiled, and/or interpreted or otherwise processed. The processed medium may then be stored in a computer and/or machine memory.

The above described systems may be embodied in many technologies and configurations that receive spoken words. In some applications the systems are integrated within or form a unitary part of a speech enhancement system. The speech enhancement system may interface or couple instruments and devices within structures that transport people or things, such as a vehicle. These and other systems may interface cross-platform applications, controllers, or interfaces.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

We claim:

1. A system that extends the high-frequency spectrum of a narrowband audio signal in the time domain comprising:

an interface configured to receive a narrowband audio signal;

a controller that extends the harmonics of vowels by introducing a non linearity in the received narrowband audio signal in the time domain; and a random noise generator that generates consonants by introducing random-noise in the received narrowband audio signal in the time domain, where the controller comprises a squaring circuit that squares a segment of the narrowband audio signal.

2. The system of claim 1 further comprising a plurality of filters that pass a portion of frequencies of the non-linearity and the random-noise, respectively.

3. The system of claim 1 further comprising a plurality of amplifiers that increase magnitudes of the non-linearity and the random-noise.

4. The system of claim 1 further comprising a plurality of mixers that select a portion of the non-linearity generated by the controller and a portion of the random-noise generated by the random-noise generator.

5. The system of claim 1 further comprising a summing circuit that sums a portion of the non-linearity generated by the controller and a portion of the random-noise generated by the random-noise generator.

6. The system of claim 1 further comprising a summing circuit that sums a portion of the non-linearity generated by the controller, a portion of the random-noise generated by the random-noise generator and the narrowband audio signal received through the interface.

7. The system of claim 6 further comprising an adaptive filter configured to dampen a background noise detected in an upper frequency of the summed signal.

8. The system of claim 6 further comprising an adaptive filter configured to vary the spectral shape of a portion of the summed signal.

9. The system of claim 1 further comprising:

a plurality of filters that pass a portion of frequencies of the non-linearity generated by the controller and the random-noise generated by the random-noise generator, respectively, a plurality of amplifiers that increase magnitudes of the non-linearity and random-noise;

a plurality of mixers that select a portion of the non-linearity generated by the controller and a portion of the random-noise generated by the random-noise generator;

a first summing circuit that sums the portion of the non-linearity generated by the controller and the portion of the random-noise generated by the random-noise generator; and a second summing circuit that sums the portion of the combined non-linearity and the random-noise with the narrowband audio signal.

10. The system of claim 9 further comprising:

a first adaptive filter configured to dampen a background noise detected in an upper frequency of the second summed signal; and a second adaptive filter configured to vary the spectral shape of a portion of the second summed signal.

11. A method that extends a high-frequency spectrum of a narrowband signal comprising:

determining if a portion of a signal represents a vowel or a consonant;

generating a first portion of a high frequency spectrum in a time domain by squaring a portion of a narrow band signal if the that portion of the narrowband signal represents the vowel;

generating a second portion of the high frequency spectrum in the time domain by generating a random signal if the portion of the narrowband signal represents the consonant; and filtering the generated high frequency signals to adjust spectral shapes and magnitude.

12. The method of claim 11 further comprising combing the generated high frequency signals with the narrowband signal.

13. The method of claim 11 further comprising conditioning the first portion of the high frequency spectrum and conditioning the second portion of the high frequency spectrum.

14. The method of claim 11 further comprising dampening the background noise in the generated high frequency spectrums.

15. The method of claim 11 further comprising adding the first portion of the high frequency spectrum to the second portion of the high frequency spectrum before filtering the summed signal.

16. The method of claim 11 further comprising:

adding the first portion of the high frequency spectrum to the second portion of the high frequency spectrum;

conditioning the first portion of the high frequency spectrum and conditioning the second portion of the high frequency spectrum;

adding the conditioned first portion of the high frequency spectrum to the conditioned second portion of the high frequency spectrum; and adding the combined first portion of the high frequency spectrum and the second portion of the high frequency spectrum to the narrowband signal.

17. The method of claim 16 further comprising dampening at least a portion of the background noise in the combined high frequency spectrum and the narrowband signal.

18. A system that extends the high-frequency spectrum of a narrowband audio signal in the time domain comprising:

an interface configured to receive a narrowband audio signal;

a controller that extends the harmonics of vowels by introducing a non linearity in the received narrowband audio signal in the time domain;

a random noise generator that generates consonants by introducing random-noise in the received narrowband audio signal in the time domain, a plurality of filters that pass a portion of frequencies of the non-linearity generated by the controller and the random-noise generated by the random-noise generator, respectively, a plurality of amplifiers that increase magnitudes of the non-linearity and random-noise;

a plurality of mixers that select a portion of the non-linearity generated by the controller and a portion of the random-noise generated by the random-noise generator;

a first summing circuit that sums the portion of the non-linearity generated by the controller and the portion of the random-noise generated by the random-noise generator;

a second summing circuit that sums the portion of the combined non-linearity and the random-noise with the narrowband audio signal a first adaptive filter configured to dampen a background noise detected in an upper frequency of the second summed signal; and a second adaptive filter configured to vary the spectral shape of a portion of the second summed signal, where the controller comprises a squaring circuit that squares a segment of the narrowband audio signal.

* * * * *